United States Patent [19]

Feuz et al.

[11] Patent Number: 4,794,864

[45] Date of Patent: Jan. 3, 1989

[54] OVERHEAD CABLE TRANSPORT INSTALLATION, ESPECIALLY AERIAL CABLEWAY

[75] Inventors: Fritz Feuz, Thun; Ferdinand Hora, Burgdorf, both of Switzerland

[73] Assignee: Von Roll Habegger AG, Thun, Switzerland

[21] Appl. No.: 61,623

[22] Filed: Jun. 15, 1987

[30] Foreign Application Priority Data

Jun. 17, 1986 [CH] Switzerland ..... 02468/86

[51] Int. Cl.[4] ..... B61B 11/00; B61B 12/02; B61K 1/00

[52] U.S. Cl. ..... 104/168; 104/173.2; 104/250

[58] Field of Search ..... 104/165, 168, 173.1, 104/173.2, 178, 249, 250

[56] References Cited

U.S. PATENT DOCUMENTS

| | | | |
|---|---|---|---|
| 3,429,279 | 2/1969 | Pomagalski | 104/173.1 |
| 3,769,914 | 11/1973 | Lorinet | 104/287 |
| 4,003,314 | 1/1977 | Pearson | 104/173.2 |
| 4,050,385 | 9/1977 | Gurr et al. | 104/178 |
| 4,187,784 | 2/1980 | Fernandez et al. | 104/173.1 |
| 4,401,034 | 8/1983 | Gaudet | 104/178 |
| 4,563,955 | 1/1986 | Tarassoff | 104/168 |
| 4,627,361 | 12/1986 | Tarassoff | 104/178 |
| 4,641,584 | 2/1987 | Bertrand | 104/178 |
| 4,669,389 | 6/1987 | Tarassoff | 104/173.2 |

FOREIGN PATENT DOCUMENTS

| | | | |
|---|---|---|---|
| 0187552 | 7/1985 | European Pat. Off. | 104/173.1 |
| 1505985 | 8/1969 | Fed. Rep. of Germany . | |
| 2162127 | 6/1973 | Fed. Rep. of Germany . | |
| 2340848 | 9/1977 | France . | |

*Primary Examiner*—George L. Walton
*Attorney, Agent, or Firm*—Werner W. Kleeman

[57] ABSTRACT

At each station of the overhead cable transport installation the vehicles which have been released or unclamped from the conveying cable are decelerated or accelerated by pneumatic wheels. Between the V-belt drive and the hub of each pneumatic wheel there is arranged a free-wheeling clutch or slip coupling equipped with a pre-biased restoring or return spring. The free-wheeling clutch transmits in one direction the torque or rotational moment from the V-belt drive to the pneumatic wheel without play. In the opposite direction such free-wheeling clutch rotates against the restoring moment of the pre-biased restoring spring. As a result there is eliminated the slip and the resultant wear of the pneumatic wheels upon the friction plate with which they come into contact during such time in which two neighboring pneumatic wheels engage with the friction plate.

8 Claims, 4 Drawing Sheets

OVERHEAD CABLE TRANSPORT INSTALLATION, ESPECIALLY AERIAL CABLEWAY

BACKGROUND OF THE INVENTION

The present invention relates to a new and improved construction of an overhead cable transport installation, especially an aerial cableway.

Generally speaking, the overhead cable transport installation, especially the aerial cableway of the present development is of the type comprising a conveying cable which revolvingly moves between two stations and vehicles or the like are decoupled or released from the travelling cable at the stations. Each station is provided with a transfer rail forming a respective inbound region and an outbound region. Friction wheels coupled with drive elements are arranged at the inbound region and the outbound region along the transfer rails. These friction wheels coact with friction plates of the vehicles which are supported upon the transfer rails. At least the portion of the friction wheels at the inbound region and the outbound region, when considered in relation to immediately neighboring friction wheels, possess different circumferential velocities in order to stepwise or incremently decelerate or brake inbound vehicles and to stepwise or incrementally accelerate outbound vehicles. The friction plates possess a length which is greater than the spacing between neighboring friction wheels having different circumferential velocities.

A chair lift or gondola lift of the aforementioned type has been disclosed in U.S. Pat. No. 4,563,955, granted Jan. 14, 1986.

The requirement that the length of the friction plate should be longer than the spacing or distance between two friction wheels, for instance constructed as pneumatic wheels or tires, is predicated upon the requirement that a vehicle, both during its acceleration and also during its deceleration, should always be controlled by at least one friction wheel, and thus, there must prevail a reliable engagement between its friction plate and this one friction wheel.

Because of the fact that in the case of an aerial cableway of such type two neighboring friction wheels must positively possess, along the acceleration path or deceleration or braking path, circumferential velocities which deviate from one another, there however results from the repetitive simultaneous engagement of two friction wheels with a friction plate a pronounced or marked wear and the resultant unintentionally performed frictional work is also at the expense of a corresponding expenditure in energy.

An overhead cable transport installation or aerial cableway which eliminates one of these drawbacks is known from the French Pat. No. 2,340,848. However, in this prior art construction of aerial cableway all of the friction wheels of one set always possess the same velocity. This velocity is increased for accelerating the vehicles and, as the case may be, decreased for decelerating or braking the vehicles, under the action of a variable drive or drive means which is controlled by a suitable control unit. This overhead cable transport installation or aerial cableway is, however, quite complicated in its design and prone to malfunction or disturbance since there are also required feelers or sensors which must be activated by the vehicles or the like.

SUMMARY OF THE INVENTION

Therefore, with the foregoing in mind it is a primary object of the present invention to provide a new and improved construction of an overhead cable transport installation which is not afflicted with the aforementioned drawbacks and limitations of the prior art constructions.

Another and more specific object of the present invention aims at the provision of a new and improved construction of an overhead cable transport installation, especially an aerial cableway, which, while maintaining simplicity of the drive of the friction wheels, effectively reduces the frictional wear of the pneumatic wheels and the friction work which must be overcome during operation of the installation.

Yet a further noteworthy object of the present invention is directed to an improved construction of overhead cable transport installation, especially an aerial cableway for carrying loads, such as typically although not necessarily passengers, which is not afflicted with the aforenoted drawbacks and limitations of the prior art constructions, wherein such overhead cable transport installation is relatively simple in construction and design, highly reliable in operation, not readily subject to breakdown or malfunction, requires a minimum of maintenance and servicing and a lesser amount of energy for its operation.

Now in order to implement these and still further objects of the invention, which will become more readily apparent as the description proceeds, the overhead cable transport installation, especially the aerial cableway, of the present development is manifested by the features that the friction wheels possessing different circumferential velocities are operatively connected by free-wheeling clutches or slip couplings with their drive elements. These free-wheeling or overrunning clutches allow a lag or trailing motion of the friction wheels relative to their drive elements at the inbound region and a lead or overrun or override motion of the friction wheels relative to their drive elements at the outbound region.

Now if in each case two pneumatic wheels rotating at different circumferential velocities come into operative engagement with a friction plate, then, viewed with respect to the direction of movement of the vehicle, the subsequent or downstream located friction wheel governs the velocity of the vehicle, whereas, again viewed with respect to the direction of movement of the vehicle, the preceding or upstream located friction wheel, by virtue of the action of the free-wheeling clutch or slip coupling, briefly assumes the same velocity.

There is preferably limited the rotation which is rendered possible by the action of the free-wheeling clutch between the friction wheel and the drive element in the circumferential direction, so that also in the reverse direction of rotation, after passing through the free-wheeling range, there can be transmitted a rotational moment or torque between the friction wheel and the drive element.

According to the invention the free-wheeling clutch or slip coupling can be designed in a cost favorable manner in that it contains entrainment elements or entrainment means which engage with circumferential play in the friction wheel, there being provided, for instance, spring or resilient means in order to retain the entrainment elements or entrainment means in a predetermined normal or starting position relative to the friction wheel and to return such back into the normal or starting position following a compression thereof.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 2 is a sectional view of a pneumatic wheel equipped with, for instance, a V-belt drive and restoring or return spring, the pneumatic wheel being depicted in engagement with a friction plate of a vehicle of the aerial cableway or the like;

DETAILED DESCRIPTION OF THE PREFERRED EMBODIMENTS

Figure 1:
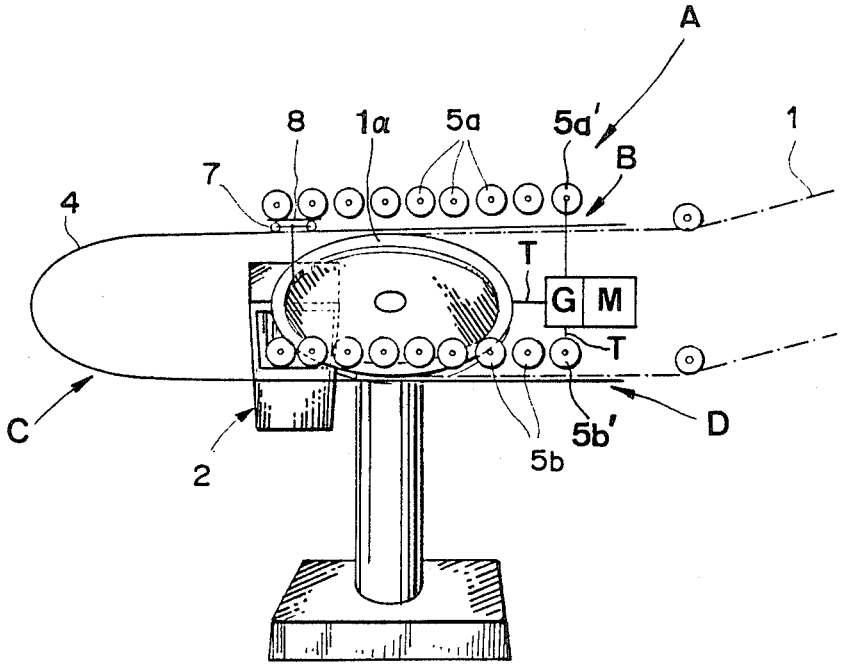
FIG. 1 schematically illustrates an overhead cable transport installation, especially an aerial cableway, located in a station or terminal.

Describing now the drawings, it is to be understood that only enough of the construction of the overhead cable transport installation has been depicted in the drawings to simplify the illustration thereof and as needed for one skilled in the art to readily understand the underlying principles and concepts of the present development. Throughout FIGS. 1 to 5 of the drawings there has been depicted, purely by way of illustration and not limitation, as the overhead cable transport installation an aerial cableway, such as a gondola lift although other types of overhead cable transport installations are equally contemplated, such as, for instance, a chair lift. Furthermore, the overhead cable installation of the present invention can be advantageously used in other fields of application, for instance in foundries, during the conveying of pallets and so forth.

Turning attention now specifically to FIG. 1 of the drawings, it is to be understood that reference numeral 1 designates a conveying or conveyor cable or equivalent conveying structure of the aerial cableway. This conveying cable 1, during operation of the aerial cableway, continuously revolves and conveyingly operatively connects or associates two stations or terminals with one another, such as the station A located at one predeterminate location or site of the conveying path, such as typically the base of a mountain with another station located at some other predeterminate location or site, for instance, located up along the mountain, such as at the top of the mountain. Furthermore, the aerial cableway comprises a multiplicity of vehicles 2 or equivalent transport facilities, such as for instance gondolas or cabins although obviously other suitable constructions of vehicles are possible, wherein in FIG. 1 only one of the vehicles 2 has been illustrated as a matter of convenience and for purposes of simplification of the representation. These vehicles 2 are appropriately operatively coupled or clamped, as is quite well known in this technology, with the conveying cable 1 and suspended thereat during the transport or travel of the individual vehicles 2 between the two stations or terminals.

At these stations or terminals the vehicles 2 are supported by means of the thereat provided carriages 7 at a transfer rail or member 4 or equivalent structure. This transfer rail or rail member 4 extends between an inbound region or zone B through an arcuate or curved portion C extending through an arc of approximately 180° to an outbound region or zone D. The inbound region or zone B and the outbound region or zone D each have operatively associated therewith sets of friction wheels, here pneumatic wheels **5*a* and 5*b*, respectively, which comprise a multiplicity of pneumatic wheels or wheel structures or equivalent facilities arranged in tandem or succession in the direction of movement of the vehicles 2**.

Figure 3:
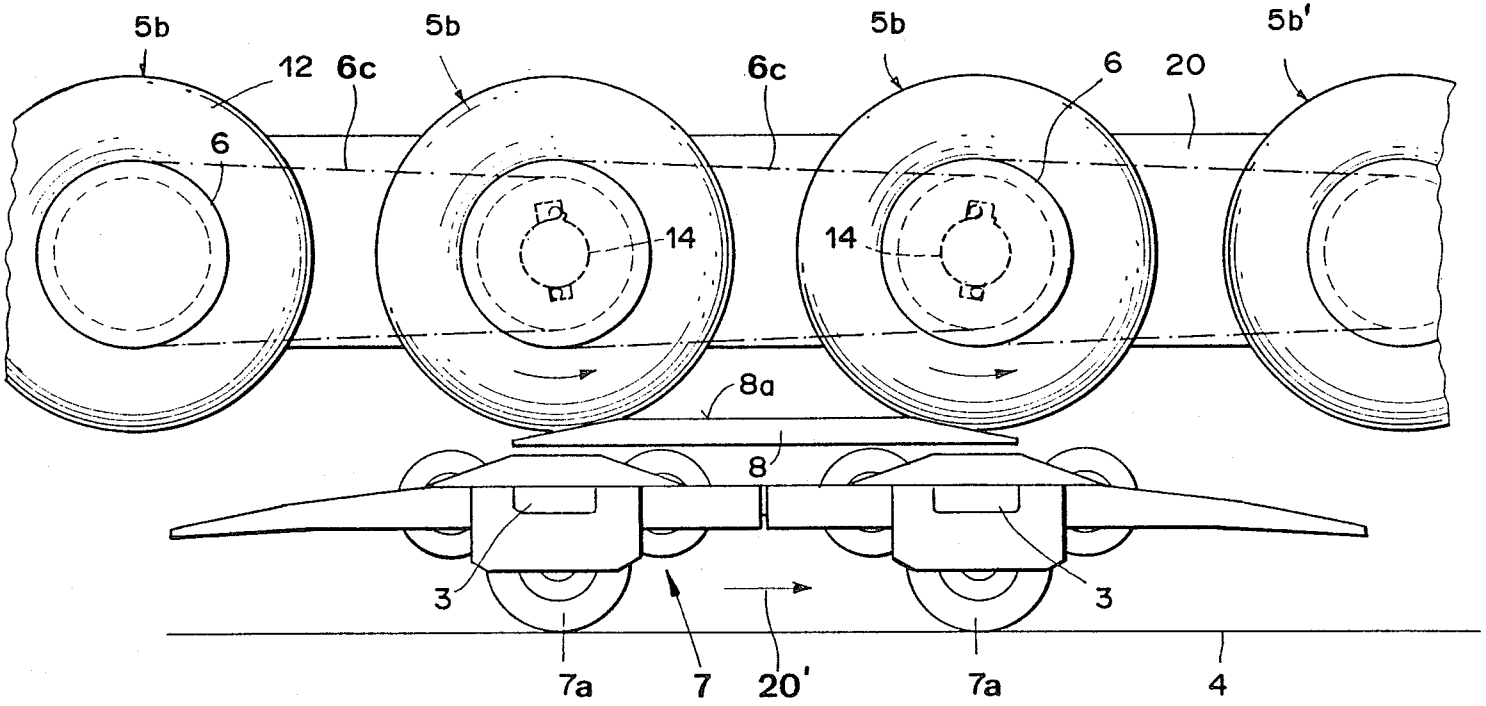
FIG. 3 is a side view depicting a plurality of pneumatic wheels, of which the two neighboring pneumatic wheels are shown in operative engagement or frictional contact with the friction plate of the related vehicle.

As will be particularly evident by referring to FIGS. 1 and 3, the depicted carriage 7 or equivalent structure of each vehicle 2 comprises, apart from the travel rolls or rollers **7*a* which bear upon the transfer rails or rail members 4, two tandemly or successively arranged suitable clamps or clamp structures 3 which allow the operative coupling or gripping engagement of each related vehicle 2 with the associated conveying cable 1. Each carriage 7 is also equipped with a friction plate or plate member 8 extending in the lengthwise direction of the associated carriage 7 and rigidly or fixedly connected therewith. This friction plate or plate member 8 extends substantially parallel to each associated transfer rail or rail member 4. The length of each friction plate 8 is somewhat greater than the spacing between two neighboring pneumatic wheels 5*a* or 5*b*, as the case may be, so that each friction plate 8 when located at the region of the relevant set or series of the pneumatic wheels 5*a* or 5*b*, as the case may be, operatively engages or frictionally contacts one of these pneumatic wheels 5*a* or 5*b***.

At the inbound region or zone B the set or group of pneumatic wheels **5*a* have assigned thereto the task of decelerating or braking the related vehicle 2 arriving or coming in at the velocity of the conveying cable 1 upon engagement with the associated friction plate or plate member 8. On the other hand, the other set or group of pneumatic wheels 5*b* located at the outbound region or zone D assume the task of accelerating each thereat arriving vehicle 2 which is in the process of departing from the station, here the station A, to the velocity of the conveying cable 1. To this end, the individual pneumatic wheels 5*a* and 5*b*** of each pneumatic wheel set are driven, in a manner to be described more fully hereinafter, so as to possess rotational speeds which differ from one another.

In any event, at the inbound region or zone, such as the inbound region or zone B of the station A depicted in FIG. 1, the pneumatic wheels **5*a* or equivalent structure which follow one another in the direction of movement of the inbound or incoming vehicles 2 possess successively decreasing rotational speeds, whereas at the outbound region or zone D of such station A the pneumatic wheels 5*b* or equivalent structure which follow one another in succession in the direction of the conveying cable 1** possess successively increasing rotational speeds.

Figure 2:
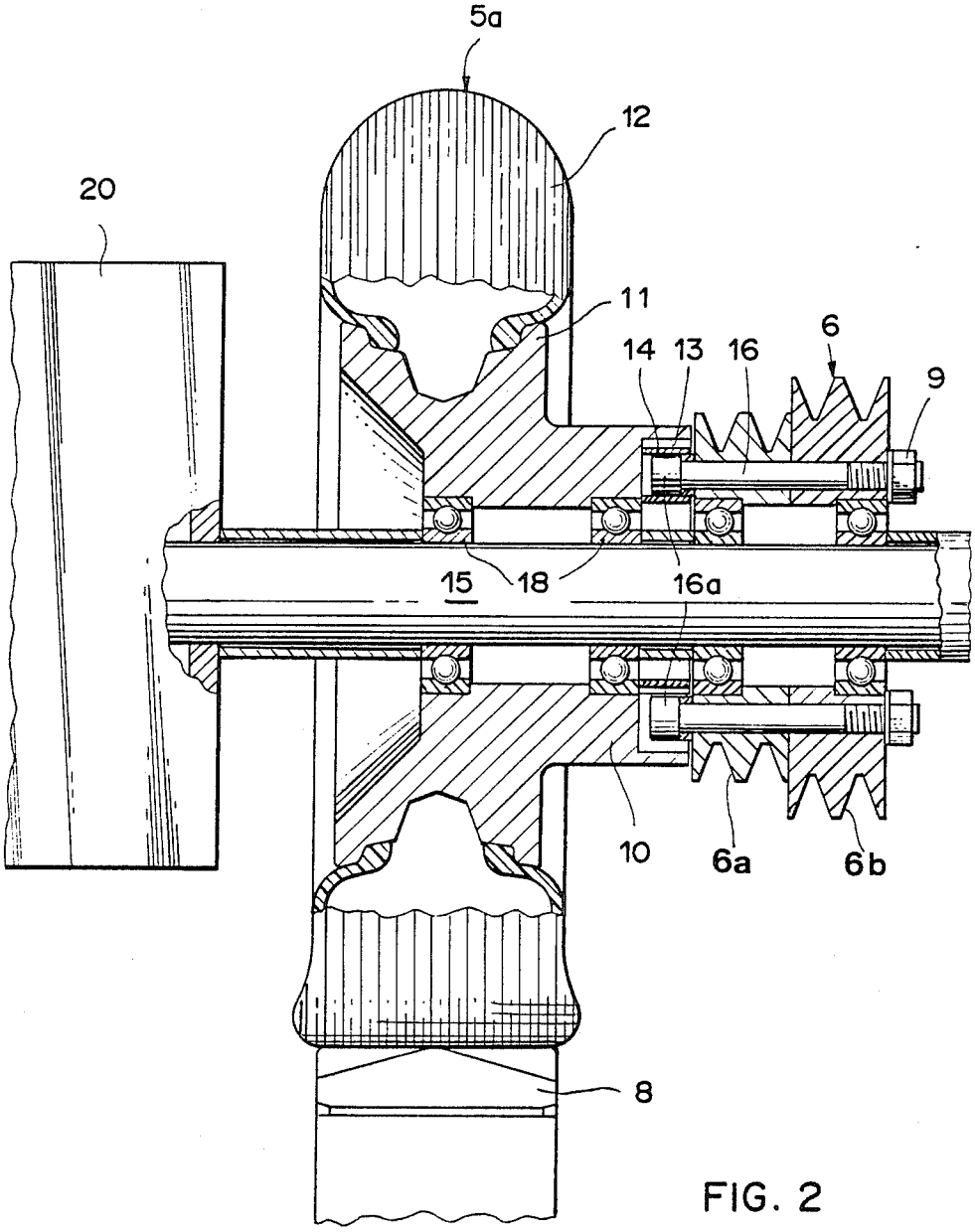

As will be readily observed by inspecting FIG. 2, each pneumatic wheel 5*a* is operatively connected with a drive element or drive means in the form of a cone or V-belt drive or drive means 6. Each pneumatic wheel 5*a* comprises a hub 10 having a recess or opening 13, a rim 11 and a tire 12. Each pneumatic wheel 5*a* is rotatably mounted by means of two roller bearings 18 or equivalent structure upon a shaft or axle 15 which likewise rotatably supports in neighboring relationship to the pneumatic wheel 5*a* two belt pulleys or discs 6*a* and 6*b* of the cone or V-belt drive or drive means 6. All of the shafts 15 of the set of pneumatic wheels 5*a* are secured in a common plane substantially parallel to one another at a carrier or support member 20 which, in turn, extends substantially parallel to the transfer rail or rail member 4 at the inbound region or zone B. The cone or V-belt pulleys or discs 6*a* and 6*b*, possessing different diameters, are mutually interconnected for non-relative rotational movement by means of two threaded bolts or screws 16 or equivalent fastening expedients arranged diametrically opposite one another and provided with the associated nut members or nuts 9 or equivalent structure. The threaded bolts or screws 16 engage by means of their head portions or heads 16*a* in diametrically oppositely situated pockets 13*a* of the recesses or openings 13 provided in the hub 10, as also particularly evident by referring to FIGS. 4 and 5.

In each such recess 13 and one of the related pockets 13*a* thereof there is inserted a pre-biased restoring or return spring 14 or equivalent structure. As will be clearly seen from FIGS. 4 and 5, each such restoring or return spring 14 comprises two spring loops 14*a* and 14*b*, wherein the smaller spring loop 14*a* encircles the head or head portion 16*a* of one of both threaded bolts or screws 16. The larger spring loop 14*b* of such restoring or return spring 14 encircles in spaced relationship the associated shaft or axle 15 of the pneumatic wheel 5*a* and bears at its one end 14*c* at location 10*a* at the related hub or hub member 10.

Figure 5:
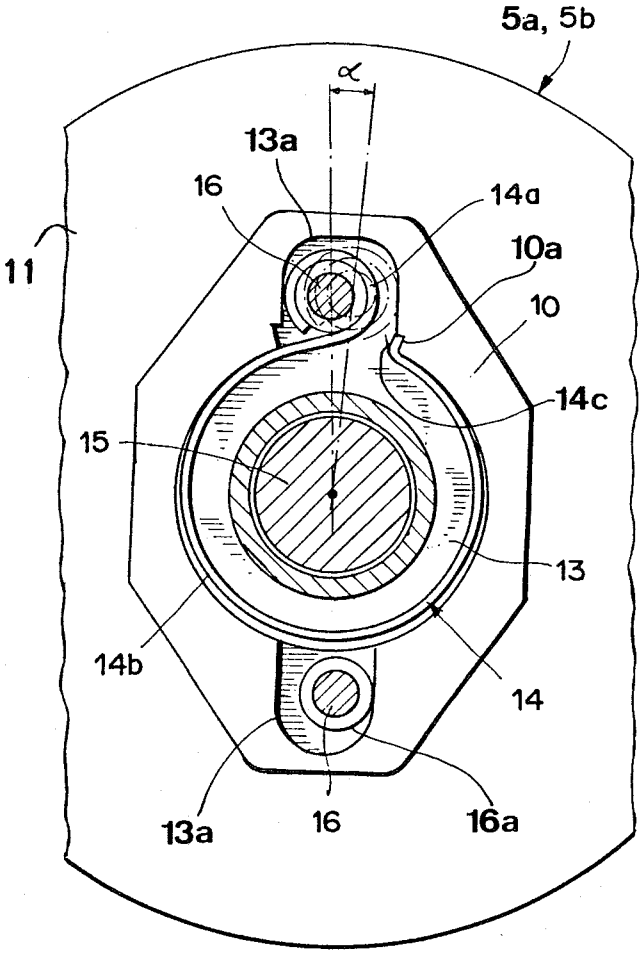
FIG. 5 is an enlarged sectional view, similar to the showing of FIG. 4, depicting the restoring or return spring in its predetermined normal or starting position and which is mounted in the recess of the hub of the related pneumatic wheel.
Figure 4:
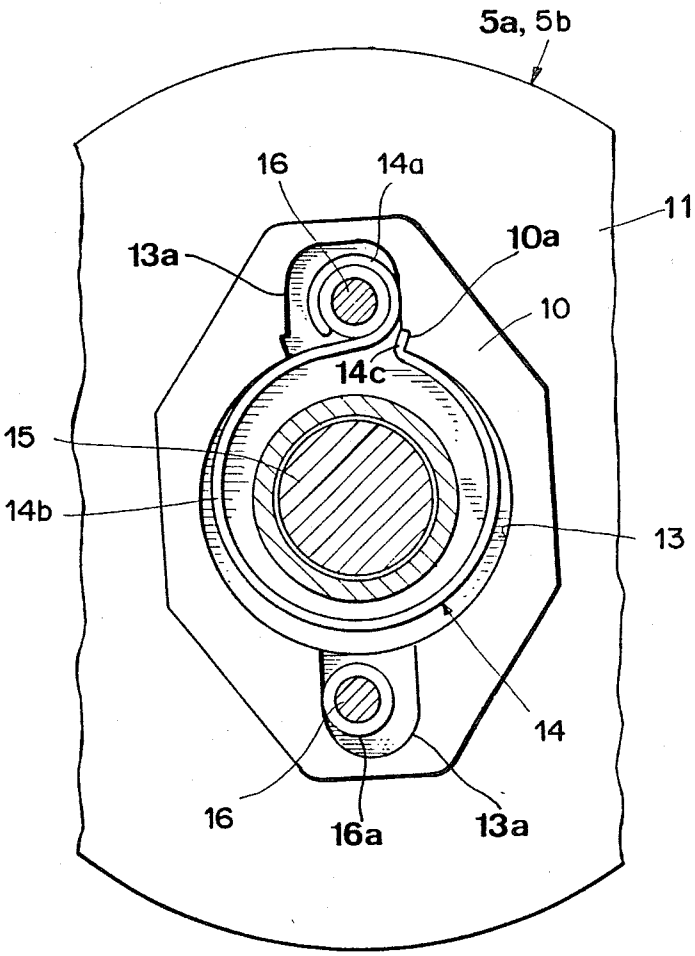
FIG. 4 is an enlarged sectional detail view of the restoring or return spring, depicted in an angularly rotated position, and mounted in a hub recess of an associated pneumatic wheel.

According to the invention, the drive elements or cone or V-belt drive or drive means 6 are operatively connected with their pneumatic wheels 5*a* by means of a respective associated free-wheeling clutch or slip coupling which is formed by the pockets 13*a* and the bolt heads 16*a*. As will be apparent from the showing of FIGS. 4 and 5, the threaded bolts or screws 16, acting as entrainment members, engage by means of their bolt heads or head members 16*a* with play in the pockets 13*a* of the hub 10 and allow for a rotation of the pneumatic wheels 5*a* relative to the drive elements or drive means 6 through the angle $\alpha$ (FIG. 5). Such rotation from the predetermined normal or starting position depicted in FIG. 5 in the direction of the end or terminal position depicted in FIG. 4 is, however, only possible in one rotational direction or sense and only against the action of the pre-biased restoring or return spring 14.

The previously described arrangement of the set of pneumatic wheels 5*a* located at the inbound region or zone B is likewise applicable to the set of pneumatic wheels 5*b* located at the outbound region or zone D of the station A.

The drive of the pneumatic wheels 5*a* and 5*b* of both sets of such pneumatic wheels 5*a* and 5*b* of the depicted station A is accomplished, for instance, by means of a suitable drive motor M which also drives the conveying cable 1 by means of a cable disc 1*a* about which there is trained or wrapped such conveying cable 1. To this end, the drive motor M is operatively connected by means of a suitable transmission or gearing unit G as well as the transmission or power transmitting shafts T with the cable disc 1*a* and the pneumatic wheels 5*a*′ and 5*b*′, and in the illustrated arrangement as depicted in FIG. 1 these transmission shafts T act upon the first pneumatic wheel 5*a*′ of the set of pneumatic wheels 5*a* of the inbound region or zone B and the last pneumatic wheel 5*b*′ of the other set of pneumatic wheels 5*b* of the outbound region D. By means of the transmission or gearing unit G both of these pneumatic wheels 5*a*′ and 5*b*′ have imparted thereto a circumferential velocity which is equal to the circumferential velocity of the cable disc or pulley 1*a* and thus the travel velocity of the conveying cable 1.

As also will be observed by reverting to FIG. 3, each cone or V-belt drive or drive means 6 comprises a cone or V-belt 6*c* which operatively drivingly interconnects the smaller diameter belt pulley 6*a* of a pneumatic wheel 5*a* or 5*b*, as the case may be, with the larger diameter belt pulley 6*b* of the next following or successive pneumatic wheel 5*a* or 5*b*, as the case may be, which in the illustration of FIG. 3 would be the next following pneumatic wheel 5*b* located at the left-hand side. Consequently, the rotational speeds of the individual pneumatic wheels 5*a* and 5*b* of each such set of pneumatic wheels or equivalent structure decrease with increasing spacing or distance from the pneumatic wheels 5*a*′ and 5*b*′, respectively.

Accordingly, a vehicle 2 or the like which arrives at the station A at the inbound region or zone B is gradually decelerated or braked by the action of the set of pneumatic wheels 5*a* upon the associated friction plate or plate member 8 supported by such vehicle 2. On the other hand, at the outbound region or zone B the set of pneumatic wheels 5*b* gradually accelerate a vehicle 2 until such has attained by the action of the last pneumatic wheel, in FIG. 1 the pneumatic wheel 5*b*′, the velocity of the conveying cable 1 and then such vehicle 2 is subsequently coupled free of any appreciable jerks or surges with this conveying cable 1 by appropriate closure of the clamps or clamp units 3, as is well known in this technology.

Based upon the illustration of FIGS. 3, 4 and 5 there will be described hereinafter the mode of operation of the free-wheeling clutch or slip coupling considered in conjunction with, by way of example, the outbound region D, that is to say, during acceleration of a vehicle 2 by the action of the pneumatic wheels 5*b* which engage at its friction plate or plate member 8.

From a displacement path section of the outbound region or zone D, at which only one of the pneumatic wheels 5*b* acts upon the friction plate or plate member 8 of a vehicle 2 and accelerates such to the travel velocity corresponding to its circumferential velocity, the vehicle 2 is conveyed in the direction of the arrow 20 and thus arrives at the position depicted in FIG. 3. As a result, the friction plate or plate member 8 comes into engagement by means of its friction surface 8*a* with a second pneumatic wheel 5*b* which follows in the vehicle direction of movement or travel, this following or successive or second pneumatic wheel 5*b* being driven at a greater circumferential velocity than the preceding pneumatic wheel 5*b*. At this next successive or second pneumatic wheel 5*b* the parts of the free-wheeling clutch or slip coupling assume the normal or starting position depicted in FIG. 5, and thus, this next successive or second pneumatic wheel 5b, is rigidly entrained during the rotation of the cone or V-belt drive 6 and the threaded bolt head 16a or the like in the counter-clockwise direction. This pneumatic wheel 5b, by virtue of the frictional contact with the friction surface 8a, entrains at its inherent higher circumferential velocity the carriage 7 riding upon the transfer rail or rail member 4. At the same time, there is exerted a frictional force by the friction plate or plate member 8 upon the preceding or upstream located pneumatic wheel 5b which is driven by its cone or V-belt drive or drive means 6 at the lower circumferential velocity. Due to the free-wheeling or slip action the corresponding preceding or upstream located pneumatic wheel can accelerate up to the speed of movement or velocity of the friction plate 8, and thus can lead or override its cone or V-belt drive in the direction of the end or terminal position depicted in FIG. 4 by virtue of the rotation or turning of the relevant parts against the action of the restoring or return spring 14. However, as soon as the friction plate or plate member 8 has come out of engagement with this preceding or upstream located pneumatic wheel 5b or the like, the restoring or return spring 14 or equivalent restoring structure rotates or turns this pneumatic wheel back 5b into the position in which the parts of the free-wheeling clutch or slip coupling assume the predetermined normal or starting position depicted in FIG. 5.

Due to the action of the free-wheeling clutch or slip coupling or equivalent structure there is thus appreciably reduced the frictional wear owing to the simultaneous action of two pneumatic wheels upon the same friction plate and which are driven at different rotational speeds, since the described operation repeats at all of the pneumatic wheels 5b of the outbound region or zone D.

At the pneumatic wheels 5a located at the inbound region or zone B the free-wheeling clutches or slip couplings perform the same function. Again each such free-wheeling clutch or slip coupling is installed such that the pneumatic wheel which follows or is successively arranged in the direction of movement of the vehicle 2—in other words in this case the pneumatic wheel driven at the lower circumferential velocity—governs the velocity of the preceding or upstream located pneumatic wheel which is in operative engagement with the same friction plate. During the deceleration or braking action exerted by a following or downstream located pneumatic wheel, viewed in the direction of movement of the vehicle 2, the preceding or upstream located pneumatic wheel is decelerated for such length of time until such comes out of operative or frictional engagement with the friction plate 8. During this time the cone or V-belt drive or drive means leads its pneumatic wheel, or stated in a different manner, such preceding or upstream located pneumatic wheel lags its associated drive means.

The angle $\alpha$ is selected as a function of the amount by which the engagement path of the friction plate 8, which is defined by its length and design, is greater than the spacing between two pneumatic wheels or their shafts or axles, as the case may be. It has been found that an angle $\alpha$ of approximately 10° is sufficient in order to eliminate the simultaneous engagement of two pneumatic wheels prior to attainment of the end or terminal position depicted in FIG. 4. The end or terminal position of FIG. 4 is only then attained if, for instance, in the case of a disturbance the pneumatic wheels should be driven in the opposite rotational direction or sense, in order to move the vehicles backwards. The friction plate or plate member 8 can be formed of a suitable plastic material and can be provided at the friction surface thereof with protuberances or raised portions, for instance transversely extending ribs or rib members.

As a general rule a part of the pneumatic wheels 5a at the end of the inbound region or zone B as well as at the start of the outbound region or zone D can be driven at the same velocity. Accordingly, there is not required any free-wheeling clutch or slip coupling or equivalent structure between such pneumatic wheels and their drive elements.

It should be readily apparent that the other station or terminal or destination would be comparably constructed to the station or terminal or destination A depicted in FIG. 1 and therefore need not here be further considered.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An overhead cable transport installation, especially an aerial cableway, comprising:

a conveying cable revolvingly travelling between two stations;

travelling vehicles carried by said conveying cable and capable of being decoupled at the stations;

a transfer rail provided at each station;

said transfer rail defining an inbound region for the travelling vehicles travelling in an inbound direction and an outbound region for the travelling vehicles travelling in an outbound direction with respect to an associated one of the stations;

friction wheels provided for both the inbound region and the outbound region;

said friction wheels being successively arranged along the transfer rail of each station at the inbound region and at the outbound region;

said friction wheels at the inbound region comprising a series of decelerating friction wheels;

said friction wheels at the outbound region comprising a series of accelerating friction wheels;

each of said friction wheels being operatively coupled with drive means;

each of said travelling vehicles having a friction plate supported upon the transfer rail at the station where each said travelling vehicle is momentarily located;

said friction wheels cooperating with said friction plates of the travelling vehicles supported upon the transfer rail of the associated station in order to control the speed of movement of the travelling vehicles when decoupled from said conveying cable;

said drive means driving each of the friction wheels of said series of decelerating friction wheels at the inbound region and each of the friction wheels of said series of accelerating friction wheels at the outbound region at a different speed with respect to a directly neighboring friction wheel in order to impose decreasing circumferential velocities at directly neighboring friction wheels at the inbound region and considered in the inbound direction and at directly neighboring friction wheels at the outbound region and considered in the outbound direction, in order to respectively stepwise decelerate incoming travelling vehicles and to stepwise accelerate outgoing travelling vehicles;

each of said friction plates possessing a length which is greater than the spacing between two neighboring friction wheels of the series of decelerating friction wheels and of the series of accelerating friction wheels;

free-wheeling clutch means operatively connecting each of the friction wheels of the series of decelerating friction wheels and of the series of accelerating friction wheels with the drive means thereof; and said free-wheeling clutch means enabling trailing of the friction wheels relative to their drive means at the inbound region of each station and enabling leading of the friction wheels relative to their drive means at the outbound region of each station in order to compensate for the different driving speeds of said drive means for any two directly neighboring friction wheels when simultaneously engaging the friction plate of one of the travelling vehicles.

2. The overhead cable transport installation as defined in claim 1, wherein:

each said free-wheeling clutch means comprises means for limiting the rotational movement of the related friction wheel relative to the drive means thereof; and each of said free-wheeling clutch means possessing further means in order to return the friction wheel and drive means into a predetermined position.

3. The overhead cable transport installation as defined in claim 2 wherein:

said further means comprise restoring spring means.

4. An overhead cable transport installation, especially an aerial cableway, comprising:

a conveying cable revolvingly travelling between two stations;

travelling vehicles carried by said conveying cable and capable of being decoupled at the stations;

a transfer rail provided at each station;

said transfer rail defining an inbound region for the travelling vehicles travelling in an inbound direction and an outbound region for the travelling vehicles travelling in an outbound direction with respect to an associated one of the stations;

friction wheels provided for both the inbound region and the outbound region;

said friction wheels being successively arranged along the transfer rail of each station at the inbound region and at the outbound region;

said friction wheels at the inbound region comprising a series of decelerating friction wheels;

said friction wheels at the outbound region comprising a series of accelerating friction wheels;

each of said friction wheels being operatively coupled with drive means;

each of said travelling vehicles having a friction plate supported upon the transfer rail at the station where each said travelling vehicle is momentarily located;

said friction wheels cooperating with said friction plates of the travelling vehicles supported upon the transfer rail of the associated station in order to control the speed of movement of the travelling vehicle when decoupled from said conveying cable;

said drive means driving each of the friction wheels of said series of decelerating friction wheels at the inbound region and each of the friction wheels of said series of accelerating friction wheels at the outbound region at a different speed with respect to a directly neighboring friction wheel in order to impose decreasing circumferential velocities at directly neighboring friction wheels at the inbound region and considered in the inbound direction and at directly neighboring friction wheels at the outbound region and considered in the outbound direction, in order to respectively stepwise decelerate incoming travelling vehicles and to stepwise accelerate outgoing travelling vehicles;

each of said friction plates possessing a length which is greater than the spacing between two neighboring friction wheels of the series of decelerating friction wheels and of the series of accelerating friction wheels;

free-wheeling clutch means operatively connecting each of the friction wheels of the series of decelerating friction wheels and of the series of accelerating friction wheels with the drive means thereof;

said free-wheeling clutch means enabling trailing of the friction wheels relative to their drive means at the inbound region of each station and enabling leading of the friction wheels relative to their drive means at the outbound region of each station in order to compensate for the different driving speeds of said drive means for any two directly neighboring friction wheels when simultaneously engaging the friction late of one of the travelling vehicles;

each said free-wheeling clutch means comprises means for limiting the rotational movement of the related friction wheel relative to the drive means thereof;

each of said free-wheeling clutch means possessing further means in order to return the friction wheel and drive means into a predetermined position;

said further means comprising restoring spring means;

said friction wheels comprise pneumatic wheels;

the drive means of each of said pneumatic wheels comprise V-belt pulleys;

entrainment means provided for the V-belt pulleys;

each said pneumatic wheel comprising hub means containing pocket means;

said entrainment means engaging with play in said pocket means of the hub means of the related pneumatic wheel to allow for rotation of the related pneumatic wheel relative to the drive means thereof; and said restoring spring means being clamped between said hub means and said V-belt pulleys.

5. The overhead cable transport installation as defined in claim 4, further including:

a shaft provided for each pneumatic wheel;

each pneumatic wheel being rotatably mounted by means of its hub means and said V-belt pulleys upon said shaft thereof;

said hub means of each pneumatic wheel comprising recess means;

said restoring spring means being arranged in the recess means of the hub means of the related pneumatic wheel;

each said restoring spring means comprising two spring loops defining a larger spring loop and a smaller spring loop;

the larger spring loop encircling the shaft of the related pneumatic wheel; and the smaller spring loop encircling threaded bolt means mounted as the entrainment means at the V-belt pulleys.

6. The overhead cable transport installation as defined in claim 5, wherein:

said threaded bolt means of each pneumatic wheel rigidly interconnect for non-relative rotational movement with respect to one another both of said V-belt pulleys and possess a bolt head encircled by the smaller spring loop.

7. An overhead cable transport installation, especially an aerial cableway, comprising:

a conveying cable revolvingly travelling between two stations;

travelling vehicles carried by said conveying cable and capable of being decoupled at the stations;

a transfer rail provided at each station;

said transfer rail defining an inbound region for the travelling vehicles travelling in an inbound direction and an outbound region for the travelling vehicles travelling in an outbound direction with respect to an associated one of the stations;

friction wheels provided for both the inbound region and the outbound region;

said friction wheels being successively arranged along the transfer rail of each station at the inbound region and at the outbound region;

said friction wheels at the inbound region comprising a series of decelerating friction wheels;

said friction wheels at the outbound region comprising a series of accelerating friction wheels;

each of said friction wheels being operatively coupled with drive means;

each of said travelling vehicles having a friction plate supported upon the transfer rail at the station where each said vehicle is momentarily located;

said friction wheels cooperating with said friction plates of the travelling vehicles supported upon the transfer rail of the associated station in order to control the speed of movement of the travelling vehicles when decoupled from said conveying cable;

said drive means driving each of the friction wheels of said series of decelerating friction wheels at the inbound region and each of the friction wheels of said series of accelerating friction wheels at the outbound region at a different speed with respect to a directly neighboring friction wheel in order to impose decreasing circumferential velocities at directly neighboring friction wheels at the inbound region and considered in the inbound direction and at directly neighboring friction wheels at the outbound region and considered in the outbound direction, in order to respectively stepwise decelerate incoming travelling vehicles and to stepwise accelerate outgoing travelling vehicles;

each of said friction plates possessing a length which is greater than the spacing between two neighboring friction wheels of the series of decelerating friction wheels and of the series of accelerating friction wheels;

means operatively connecting each of the friction wheels of the series of decelerating friction wheels and of the series of accelerating friction wheels with the drive means thereof; and said operatively connecting means enabling trailing of directly neighboring friction wheels operating at different circumferential velocities relative to their drive means at the inbound region of each station and enabling leading of directly neighboring friction wheels operating at different circumferential velocities relative to their drive means at the outbound region of each station in order to compensate for the different driving speeds of said drive means for any two directly neighboring friction wheels when simultaneously engaging the friction plate of one of the travelling vehicles.

8. An overhead cable transport installation, especially an aerial cableway, comprising:

a conveying cable revolvingly travelling between two stations;

travelling vehicles carried by said conveying cable and capable of being decoupled at the at least one station;

a rail member provided at the at least one station;

said rail member defining an inbound region for the travelling vehicles travelling in an inbound direction and an outbound region for the travelling vehicles travelling in an outbound direction with respect to the at least one station;

friction wheels provided for both the inbound region and the outbound region of the at least one station;

said friction wheels being successively arranged along the rail member of the at least one station at the inbound region and at the outbound region;

said friction wheels at the inbound region comprising a series of decelerating friction wheels;

said friction wheels at the outbound region comprising a series of accelerating friction wheels;

drive means provided for each of said friction wheels;

each of said travelling vehicles having a friction plate supported upon the rail member at the at least one station where each said vehicle is momentarily located;

said friction wheels cooperating with said friction plates of the travelling vehicles supported upon the rail member of the at least one station in order to control the speed of movement of the travelling vehicles when decoupled from said conveying cable;

said drive means driving each of the friction wheels of said series of decelerating friction wheels at the inbound region and each of the friction wheels of said series of accelerating friction wheels at the outbound region at a different speed with respect to a directly neighboring friction wheel in order to impose decreasing circumferential velocities at directly neighboring friction wheels at the inbound region and considered in the inbound direction and at directly neighboring friction wheels at the outbound region and considered in the outbound direction, in order to stepwise decelerate incoming travelling vehicles and to stepwise accelerate outgoing travelling vehicles;

each of said friction plates possessing a length which is greater than the spacing between two neighboring friction wheels of the series of decelerating friction wheels and of the series of accelerating friction wheels;

means operatively connecting each of the friction wheels of the series of decelerating friction wheels and of the series of accelerating friction wheels with the drive means thereof; and said operatively connecting means enabling trailing of directly neighboring friction wheels operating at different circumferential velocities relative to their drive means at the inbound region for the travelling vehicles at said at least one station and enabling leading of directly neighboring friction wheels operating at different circumferential velocities relative to their drive means at the outbound region of said at least one station in order to compensate for the different driving speeds of said drive means for any two directly neighboring friction wheels when simultaneously engaging the friction plate of one of the travelling vehicles.

* * * * *